United States Patent [19]

Weidman et al.

[11] 4,215,728

[45] Aug. 5, 1980

[54] ELECTRONIC THREAD TRAVEL MONITORING DEVICE

[75] Inventors: Erich Weidman, Wetzikon; Walter Graf, Greifensee, both of Switzerland

[73] Assignee: Gebrüder Loepfe AG, Wetzikon, Switzerland

[21] Appl. No.: 13,969

[22] Filed: Feb. 22, 1979

[30] Foreign Application Priority Data

Mar. 3, 1978 [CH] Switzerland ..... 2568782/78

[51] Int. Cl.[2] ..... D03D 51/34

[52] U.S. Cl. ..... 139/370.2; 242/47.01; 139/450

[58] Field of Search ..... 139/336, 370.1, 370.2, 139/450, 452; 242/47.01; 66/163

[56] References Cited

U.S. PATENT DOCUMENTS

| | | | |
|---|---|---|---|
| 4,051,871 | 10/1977 | Vella | 139/370.2 |
| 4,095,621 | 6/1978 | Kakinaka | 139/370.2 |
| 4,132,368 | 1/1979 | Schiess et al. | 242/47.01 |
| 4,165,049 | 8/1979 | Pejchal et al. | 242/47.01 |

FOREIGN PATENT DOCUMENTS

| | | | |
|---|---|---|---|
| 489642 | 6/1970 | Switzerland | 139/370.2 |

*Primary Examiner*—Henry Jaudon

*Attorney, Agent, or Firm*—Werner W. Kleeman

[57] ABSTRACT

An electronic thread travel monitoring device on a shuttleless weaving machine which comprises at least one weft yarn supply bobbin and thread storing device serves for detecting yarn breaks occurring between supply bobbin and storing device. In the event of such a yarn break, the monitoring device causes the machine to stop before the broken yarn end enters the weaving shed.

5 Claims, 4 Drawing Figures

ELECTRONIC THREAD TRAVEL MONITORING DEVICE

BACKGROUND OF THE INVENTION

The present invention refers to an electronic thread travel monitoring device on a weaving machine provided with stationary weft yarn supply means and intermittently actuatable thread storing means arranged on the same side of the weaving machine. Generally, such monitoring devices serve for stopping the weaving machine in the event of yarn breaks.

Weaving machines of the type which are known as shuttleless weaving machines are used in practice on a large scale, e.g. gripper shuttle weaving machines, gripper weaving machines and jet weaving machines. With the first named gripper shuttle weaving machines, the weft or filling thread is inserted into the weaving shed by a flying gripper shuttle or projectile. On the gripper weaving machines, weft inserting devices are provided which are positively driven by rigid rapiers or flexible tapes.

Moreover, it is known to provide a thread storing device on such a weaving machine between the supply bobbin and the start position of the weft inserting device. On a thread winding drum of this thread storing device a winding of the weft yarn drawn off the supply bobbin is formed. During the weft or filling insertion, a yarn end is drawn from the drum and inserted into the weaving shed. The axial dimension of the winding is monitored by an electronic light barrier which controls the drive of the thread storing device. By means of such a thread storing device, the tension of the weft yarn which occurs during the weft insertion is reduced, such minimizing the danger of weft breaks within the shed.

However, it appears that yarn breaks may also occur between the supply bobbin and the thread storing device when thin places are present in the yarn. Now it is desirable to detect such yarn breaks as early as possible. Modern weaving machines are normally fitted with a weft monitor which detects breaks of the weft or filling thread only upon insertion in the weaving shed, and stops the machine. When such an event occurs with a gripper shuttle weaving machine provided with a dobby, firstly the yarn end inserted in the shed by the projectile must be manually removed. Then the dobby must be reset such that the last correctly entered weft thread is exposed in the shed, and thereupon a new weft end is to be drawn from the supply bobbin to and through the thread storing device and a following thread brake and yarn guides of the weaving machine. After all this, the weaving machine may be started again. The analogous procedure is still more time-consuming with a Jacquard machine.

Now when such an early yarn break in advance of the thread storing device can be detected and the weaving machine stopped in time, the said procedures at the weaving machine as well as at the dobby or Jacquard machine are avoided since the weft or filling thread is correctly inserted in the weaving shed. In this event, only the thread end connected to the supply bobbin must be drawn towards or eventually through the thread storing device and knotted to the other thread end.

SUMMARY OF THE INVENTION

It is a primary object of the invention to provide a device for immediately detecting thread breaks which occur in advance of the thread store and stopping the machine in such an event.

This and other objects which will be apparent as the description proceeds may be realized by the inventive electronic thread travel monitoring device comprising thread sensing means arranged between the weft yarn supply means and thread storing means, for producing signals indicative of thread travel; store control means for producing actuating signals indicative of the condition "storing means depleted of yarn"; and logic means controlled by the thread travel signals and actuating signals, for producing output signals when no thread travel signal is present at any moment of the existence of an actuating signal.

Since yarn breaks occurring in advance of the thread store are immediately detected by the inventive monitoring device or inlet monitor, it is easy to eliminate such breaks since a broken yarn end cannot be inserted into the weaving shed.

BRIEF DESCRIPTION OF THE DRAWINGS

The invention will be better understood upon consideration of the following detailed description thereof which makes reference to the annexed drawings wherein.

DETAILED DESCRIPTION OF THE INVENTION

Figure 1:
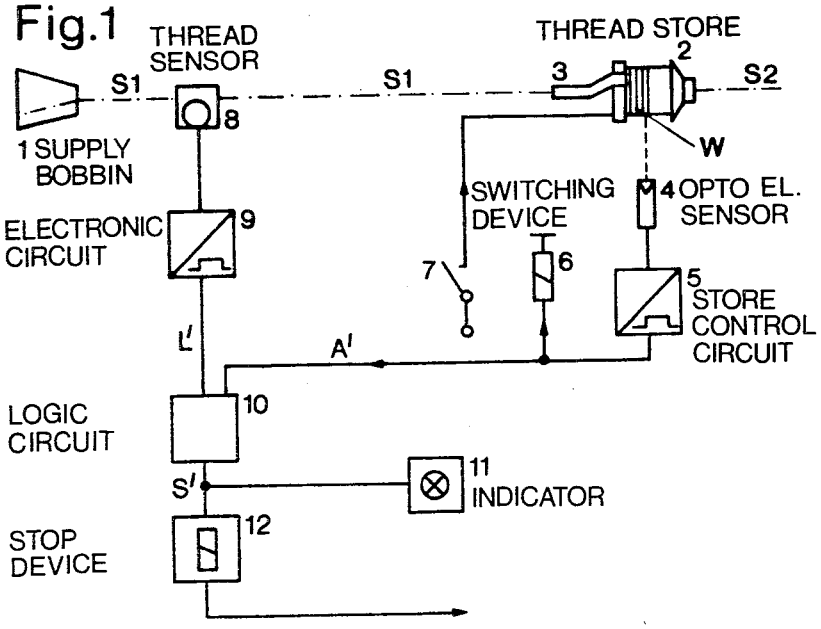
FIG. 1 illustrates a thread storing device associated with an optoelectrical control device, and a therewith combined inventive thread monitoring device or inlet monitor in block schematic.
Figure 4:
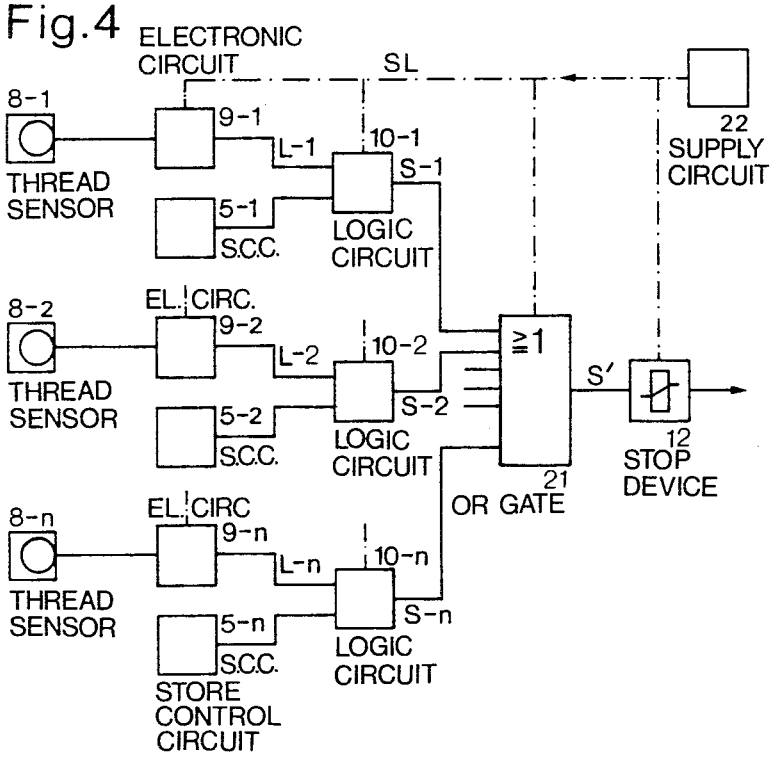
FIG. 4 illustrates the arrangement of a multiple thread monitoring device on a so-called shuttleless multicolour weaving machine.

With reference to FIG. 1, there are shown only those components and circuits in schematic representation which are essential for understanding the invention. A single weft or filling thread supply bobbin 1 is associated with a thread storing device or store 2. Generally, this representation holds also in the case that a plurality of supply bobbins and individually associated thread stores are provided as shown in FIG. 4 and as will still be described in the following context.

FIG. 1 shows a winding device which may be of known construction comprising the components 2–7 in the idle condition thereof. From supply bobbin 1 a thread end S1 runs to and is introduced through an inlet tube 3 provided with a flyer to winding W on thread store 2. The outgoing thread end S2 runs to an insertion device, such as a gripper shuttle, which enters the thread end S2 into the shed upon actuation of a picking device (not shown).

Winding device 2–7 operates independent of the drive of the weaving machine in the following manner. Prior to operation, thread end S1 is introduced into thread store 2 through inlet tube 3. Thereafter, the electrical components 4–6 are switched to a voltage supply. Optoelectrical sensor 4 monitors thread store 2; as long as there is no winding W present, a store control circuit 5 actuates a switching device 6 so that contact 7 thereof is closed and a drive means (not shown) in thread store 2 is actuated. Thus, flyer inlet tube 3 is rotated and a winding W is formed proceeding in a direction from left to right. Now when winding W has proceeded thus far that sensor 4 can detect the same, contact 7 is opened and the store drive stopped. The ready condition prior to starting the weaving machine, i.e. prior to the first weft insert, thus is established. Since weft yarn end S2 is drawn off thread store 2 with any weft insertion, winding W is intermittently reduced, and winding device 2–7 is actuated for replenishing winding W.

In addition to known winding device 2–7 an inventive electronic thread monitor comprising the components 8–12 is provided. The electronic thread monitor 8–12 detects yarn breaks of the thread end S1 upstream of the thread store 2, and in such an event causes the weaving machine to stop. Electronic thread monitor 8–12 comprises as main components a thread sensor 8, a sensor electronic circuit 9, a logic circuit 10 and a stop device 12 which, in this sequence, are serially connected. In addition, an optical indicator 11 is connected to the output of logic circuit 10. The latter has a second input connected to the output of store control unit 5.

On the whole, the equipment shown in FIG. 1 operates with the weaving machine in action as follows. So long as there is no or only a short winding on thread store 2, store control unit 5 produces an output motor pulse A' which actuates thread store 2 such that thread end S1 is drawn from supply bobbin 1. The running thread end S1 excites sensor 8, and sensor electronic circuit 9 produces a travel pulse L'. Motor pulse A' and travel pulse L' are combined in logic circuit 10; no ouput stop pulse S' is delivered when both pulses A' and L' occur simultaneously, and stop device 12 remains idle. However, when thread end S1 breaks or there is no thread end S1 at all, a stop pulse S' is produced causing, through stop device 12, the weaving machine to stop. The same process takes place when, with running drive of thread store 2, thread end S1 is drawn off by thread store 2 without being wound up thereon. Simultaneously with the occurrence of a stop pulse S', indicator 11 responds e.g. by flashing a glow lamp or light-emitting diode. Preferably, such an optical indicating device is also provided on sensor 8 and/or thread store 2.

Figure 2:
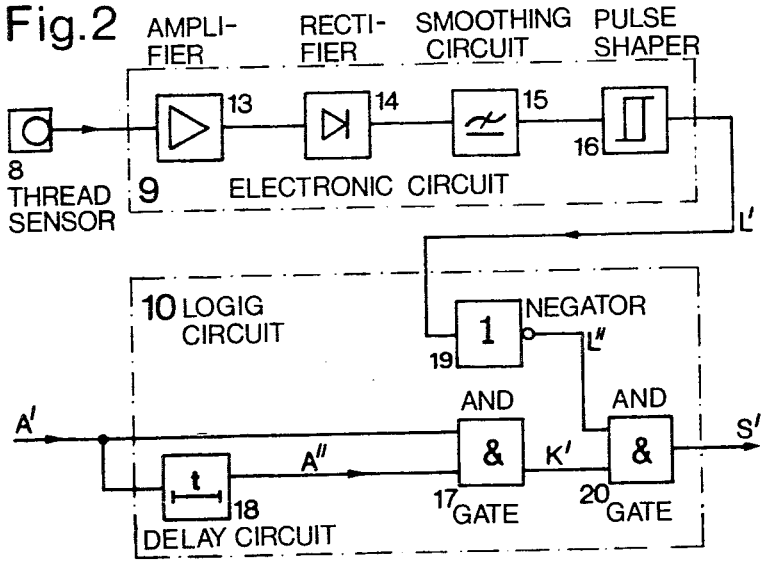
FIG. 2 illustrates the arrangement of the electronic circuits of the thread monitoring device, represented by functional units.

FIG. 2 shows the thread sensor 8 and the set-up of sensor electronic circuit 9 and logic circuit 10 with functional units.

Thread sensor 8 may comprise a known transducer, such as a capacitive, triboelectrical, piezoelectrical or optoelectrical transducer, for producing a sensing signal having noise signal wave form when the thread is travelling. Sensor electronic circuit 9 operatively connected to thread sensor 8 comprises a series arrangement of amplifier 13, rectifier 14, smoothing circuit 15 and pulse shaper, e.g. a Schmitt-trigger 16. Thread sensor 8 and sensor electronic circuit 9 may be assembled in a structural unit. By the travelling thread end S1, a rectangular travel pulse L' is produced at the output of pulse shaper 16.

Logic circuit 10 has two inputs, a first travel pulse L' input connected to sensor electronic circuit 9, and a second motor pulse A' input connected to store control circuit 5. The L' input transfers travel pulse L' to a negator 19 for inverting travel pulse L' into a pulse L''. The output of negator 19 is connected to the first input of a first AND-gate 20. The second input of logic circuit 10 is directly connected to the first input of a second AND-gate 17 and further, through a delay circuit 18, to the second input of the second AND-gate 17. The output K' of the latter is connected to the second input of the first AND-gate 20.

Figure 3:
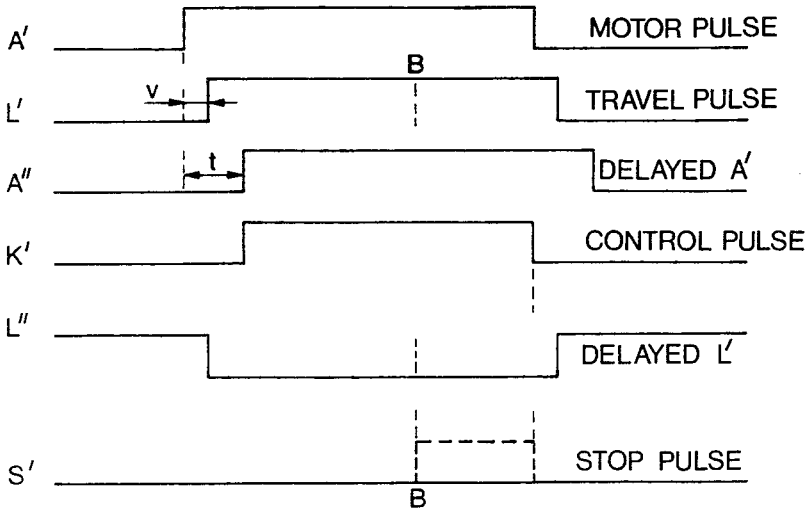
FIG. 3 is a pulse diagram illustrating the mode of operation of the thread monitoring device.

With reference to FIG. 2, the pulses produced in the interior of logic circuit 10 are denominated by A'', K' and L''. The meaning of these pulses will be apparent from the following description referring to the pulse diagrams of FIG. 3. Therein, motor pulse A' of thread store 2 is represented by a rectangular pulse. Travel pulse L' is delayed by a short start time interval v relative to motor pulse A' since thread store 2 starts and stops, because of its mechanical inertia, with some retardation. Thus, travel pulse L' starts by an interval v later than motor pulse A'. A vertical dashed line at breaking point B represents a premature end of travel pulse L' in the event of a break of thread end S1, FIG. 1. The variable or adjustable delay t effected by delay circuit 18 is to be chosen such that it is safely greater than the longest possible start delay v, as shown in FIG. 3 by the pulse A'' delayed relative to motor pulse A'. Logic addition of the pulses A' and A'' in second AND-gate 17 gives rise to a control pulse K' whose leading edge is delayed by the interval t and whose rear edge coincides with the one of motor pulse A'. Control pulse K' defines the time interval in which travel pulse L' is monitored. For this purpose, control pulse K' is combined with the inverted travel pulse L'' in the first AND-gate 20. In case of undisturbed operation of the weaving machine, pulse L'' is negative during the entire duration of control pulse K', and the first AND-gate 20 does not produce a logic stop pulse S'. However, when thread end S1 breaks during control pulse K' as represented by the dashed vertical line through point B, a positive stop pulse S' is generated which, by means of stop circuit 12, FIG. 1, causes the weaving machine to stop.

It may occur as mentioned above that thread store 2 does not wind up the thread end S1 though the drive of thread store 2 is working. No travel signal L' is produced, FIG. 3, however a stop pulse S' is produced in this event, and the weaving machine is stopped. Thus, so-called tensioning inserts which cause delayed weft or filling insertion or weft break are avoided.

With reference to FIG. 4, there is shown the circuitry of a multiple electronic device for monitoring a multiplicity of alternatively insertable weft or filling thread ends, such as thread end S1 in FIG. 1, on a shuttleless so-called multicolour weaving machine. Such machines are known, and generally they are provided with a multiplicity of supply bobbins, such as supply bobbin 1 in FIG. 1, and with a colour changing device which selects one of the weft threads and places the same in position for insertion in the weaving shed. Any supply bobbin is associated with an individual complete winding device, such as shown in FIG. 1 by the components 2–7. All these winding devices operate independent of each other and the drive of the weaving machine.

FIG. 4 shows only the store control circuits 5-1 to 5-n of the winding devices equivalent to store control circuit 5 in FIG. 1. The multiple thread monitoring device comprises sensors 8-1 to 8-n each of which senses one of the n weft threads, n sensor electronic circuits 9-1 to 9-n, and n logic circuits 10-1 to 10-n. The arrangement of any set of components, such as 5-1, 8-1, 9-1 and 10-1, corresponds to the analogous one of the components 5,8,9 and 10 in FIG. 1.

Normally only the one of the weft threads which is positioned for insertion into the weaving shed is sensed such that a travel pulse L-1, L-2 etc. is produced. In the event of a thread break in advance of the thread store a stop signal on one of the output lines S-1 to S-n is generated.

To each of the output lines S-1 to S-n of the logic circuits 10-1 to 10-n there is connected one of the n inputs of an OR-gate 21. Now when a stop signal appears on one of these output lines S-1 to S-n, this stop signal passes the OR-gate 21, and a stop signal S' appears at the output thereof which actuates stop device 12 and stops the weaving machine. Thus, only a single stop device 12 is necessary.

Normally, gripper shuttle weaving machines, as mentioned above in the introduction, are provided with a conventional electronic device for monitoring the weft insert. In FIG. 4, the supply circuit 22 and the stop device 12 may be components of such a weft monitoring device. In such case, the stop signal S' is supplied to the yet existing stop device 12, and the supply circuit 22 energizes the circuits 9-1, 10-1 etc. and OR-gate 21 through the dotted line SL. Such a common use of the components 12 and 22 for both said monitoring devices provides for an essential saving of structural elements.

While there are shown and described present preferred embodiments of the invention, it is to be distinctly understood that the invention is not limited thereto, but may be otherwise variously embodied and practiced within the scope of the following claims. Accordingly,

What we claim is:

1. An electronic thread travel monitoring device on a weaving machine provided with stationary weft yarn supply means and intermittently actuatable thread storing means arranged on the same side of the weaving machine, comprising:

(a) thread sensing means arranged between the weft yarn supply means and thread storing means, for producing signals indicative of thread travel;

(b) store control means for producing actuating signals indicative of the condition "storing means depleted of yarn"; and (c) logic means controlled by the thread travel signals and actuating signals, for producing output signals when no thread travel signal is present at any moment of the existence of an actuating signal.

2. The electronic thread travel monitoring device as defined in claim 1, comprising means for delaying said thread travel signals antecedent said logic means.

3. The electronic thread travel monitoring device as defined in claim 2, on a weaving machine provided with weft yarn supply means comprising a plurality of stationary weft yarn supply bobbins and thread storing means comprising a plurality of thread storing devices individually associated with the weft yarn supply bobbins, wherein the thread sensing means comprises a plurality of thread sensors, the store control means comprises a plurality of store control devices, and the logic means comprises a plurality of logic circuits and OR-gate means operatively connected to the outputs of the logic circuits.

4. The electronic thread travel monitoring device as defined in claim 1, on a weaving machine provided with weft yarn supply means comprising a plurality of stationary weft yarn supply bobbins and thread storing means comprising a plurality of thread storing devices individually associated with the weft yarn supply bobbins, wherein the thread sensing means comprises a plurality of thread sensors, the store control means comprises a plurality of store control devices, and the logic means comprises a plurality of logic circuits and OR-gate means operatively connected to the outputs of the logic circuits.

5. The electronic thread travel monitoring device as defined in claim 1, wherein the logic means has an output operatively connected to means for stopping the weaving machine.

* * * * *